US005814951A

United States Patent [19]

Smolka et al.

[11] Patent Number: 5,814,951

[45] Date of Patent: Sep. 29, 1998

[54] LOW-PRESSURE DISCHARGE LAMP CONTAINING A PARTITION THEREIN

[75] Inventors: Ernst Smolka, Speyer; Klaus-Juergen Dietz, Wiesbaden; Franz Schilling, Maintal; Anke Schnabl, Hammersbach; Beate Herter, Stuttgart, all of Germany

[73] Assignee: Heraeus Noblelight GmbH, Hanau, Germany

[21] Appl. No.: 769,550

[22] Filed: Dec. 19, 1996

[30] Foreign Application Priority Data

Dec. 20, 1995 [DE] Germany ..... 195 47 519.4

[51] Int. Cl.[6] ..... H01J 61/30; H05B 37/00

[52] U.S. Cl. ..... 315/326; 315/246; 315/344; 313/609

[58] Field of Search ..... 313/634, 573, 313/609, 610, 611, 612; 315/326, 248, 246, 267, 338, 344

[56] References Cited

U.S. PATENT DOCUMENTS

| | | | |
|---|---|---|---|
| 2,068,595 | 1/1937 | Burns . | |
| 2,298,239 | 10/1942 | Stirnkorb . | |
| 3,502,929 | 3/1970 | Richter et al. . | |
| 4,816,719 | 3/1989 | Maya et al. | 313/573 |
| 4,884,007 | 11/1989 | Lagushenko et al. | 313/573 |
| 5,327,049 | 7/1994 | Smolka et al. . | |

FOREIGN PATENT DOCUMENTS

| | | |
|---|---|---|
| 0 184 217 | 6/1986 | European Pat. Off. . |
| 633760 | 8/1936 | Germany . |
| 911870 | 5/1954 | Germany . |
| 1 731 577 | 10/1955 | Germany . |
| 22 02 681 | 8/1972 | Germany . |
| 32 40 164 | 5/1984 | Germany . |
| 41 20 730 | 1/1993 | Germany . |
| 1003873 | 9/1965 | United Kingdom . |
| 2 257 562 | 1/1993 | United Kingdom . |

*Primary Examiner*—Robert J. Pascal
*Assistant Examiner*—David H. Vu
*Attorney, Agent, or Firm*—Frishauf, Holtz, Goodman, Langer & Chick, P.C.

[57] ABSTRACT

A low-pressure discharge lamp, in particular a deuterium lamp, including a cylindrically symmetric partition unit which forms two hollow spaces at each of the sides of the discharge lamp. Both hollow spaces are connected through an opening in the partition unit, which confines the plasma generated by a high-frequency electromagnetic field to pass through the opening to increase the intensity of the emitted radiation. Both sides of the cylindrically symmetric partition unit are provided with a hermetic seal, at least one of which sides is a radiation emission window. The generation of the electromagnetic field takes place capacitatively through electrodes located on the sides of the discharge lamp. At least one of the electrodes is disposed on the radiation emission exit window and has an opening for the radiation to exit.

17 Claims, 4 Drawing Sheets

LOW-PRESSURE DISCHARGE LAMP CONTAINING A PARTITION THEREIN

BACKGROUND OF THE INVENTION

1. Field of the Invention

The present invention relates to a low-pressure discharge lamp having an envelope in which a plasma is formed by a high-frequency electromagnetic field and in which the radiation generated by the plasma exits the envelope along a given radiation axis, wherein a narrowed section (a partition) of the envelope disposed within the plasma has an opening along the exit axis.

2. Background Information

U.S. Pat. No. 5,327,049 (the entire contents of which are hereby incorporated by reference) and DE-OS 41 20 730 disclose an electrodeless low-pressure discharge lamp wherein a plasma is formed in a bulb by a high-frequency electromagnetic field. The radiation generated by the plasma in U.S. Pat. No. 5,327,049 and DE-OS 41 20 730 exits the bulb. A diaphragm unit (cylindrical aperture member) made of a material with high temperature stability is disposed within the plasma. The diaphragm unit contains an opening for confining the plasma. The diaphragm unit includes an optical axis through the opening along which the radiation exits. To obtain sufficiently high radiation flux and radial intensities when confining plasma in a high-frequency field, the materials must withstand high wall loads so that, at temperatures exceeding 1500° Kelvin, the materials will not disintegrate, melt, release impurities or even burst due to thermal shock when switching the lamp on and off.

U.S. Pat. No. 5,327,049 and DE-OS 41 20 730 disclose that boron nitride is the preferred material for the diaphragm unit.

In U.S. Pat. No. 5,327,049 and DE-OS 41 20 730, due to the bulb surrounding the plasma, heat elimination from the area of the diaphragm unit in which the plasma is confined is problematic. With the increasing miniaturization of radiation sources, the known discharge lamp is relatively costly with respect to its construction.

GB-PS 10 03 873 describes an electrodeless high-frequency discharge spectral lamp which contains a concavely-closed bulb consisting of a translucent material. The bulb is separated into two sections, which are connected to each other by a capillary duct. Electromagnetic arrangements for exciting a discharge inside the metal vapor present in the bulb are provided. The generation of the electromagnetic energy for discharging purposes is provided by a coil arrangement surrounding the bulb, whereby the actual ignition takes place via external electrodes.

GB-PS 10 03 873 suffers from considerable ignition problems, requiring additional electrodes to be provided in the outer area of the bulb to start the ignition. Radiation directed along a preferred radiation axis is not provided in this connection.

Furthermore, the size of the lamp of GB-PS 10 03 873 presents an obstacle particularly with the small-scale constructions required by increasing miniaturization.

SUMMARY OF THE INVENTION

An object of the present invention is thus to provide an improved low-pressure discharge lamp.

A further object of the present invention is to provide a low-pressure gas discharge lamp with a continuous spectrum with a radial intensity as high as possible, while maintaining high radiation stability.

A still further object of the present invention is to provide a low-pressure discharge lamp having a simple, mechanical construction with small geometric dimensions, to be capable for use as a light source in spectrophotometers and HPLC detectors, in particular, in a spectral region of the X wavelength from about 200 to about 350 nm, with high radiation stability.

The above objects, as well as other objects, aims and advantages are met by the present invention.

According to the present invention, a low-pressure discharge lamp comprises: a lamp envelope having a first sealed end portion and a second sealed end portion, the lamp envelope having a gas fill sealed therein. The gas fill forms a plasma in response to an application of a high-frequency electromagnetic field. The lamp envelope includes a partition unit which comprises: (i) a side wall defining an interior space and (ii) a partition extending inwardly from the side wall and being formed integrally of an opaque (non-transparent), high temperature-resistant material as a single piece with the side wall. The partition is disposed between the first sealed end portion and the second sealed end portion to divide the interior space of the lamp envelope into a first subspace and a second subspace. The partition has an aperture therethrough which communicates with the first subspace and the second subspace. The aperture has a cross-sectional size which is substantially smaller than a cross-sectional size of the lamp envelope at least at the first sealed end portion or the second sealed end portion, thereby constricting the plasma such that radiation generated by the plasma is emitted from the lamp envelope along an optical axis of the lamp envelope, which coincides with an optical axis of the aperture. At least one of the first sealed end portion and the second sealed end portion includes a radiation emission window which is pervious to radiation generated by the plasma. An electrode is disposed at each of the first sealed end portion and the second sealed end portion. At least one of the electrodes is disposed on the radiation emission window, the at least one electrode has an opening which coincides with the optical axis of the lamp envelope and is in registration with the optical axis of the aperture.

BRIEF DESCRIPTION OF THE DRAWINGS

For the purposes of illustrating the invention there is shown in the drawings forms which are presently preferred. It is to be understood, however, that the present invention is not limited to the precise arrangements and instrumentalities depicted in the drawings.

DETAILED DESCRIPTION OF THE INVENTION

Figure 1A:
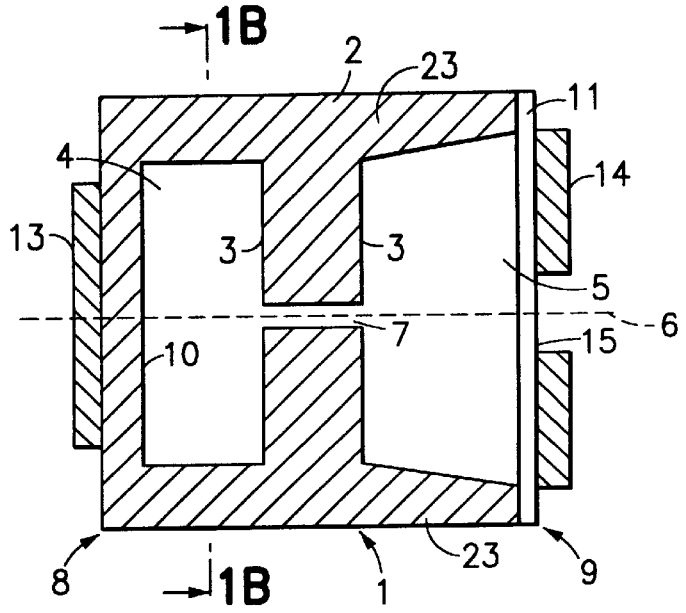
FIG. 1A is a longitudinal sectional view of a gas discharge lamp according to the present invention having a radiation exit window at one end thereof.
Figure 1B:
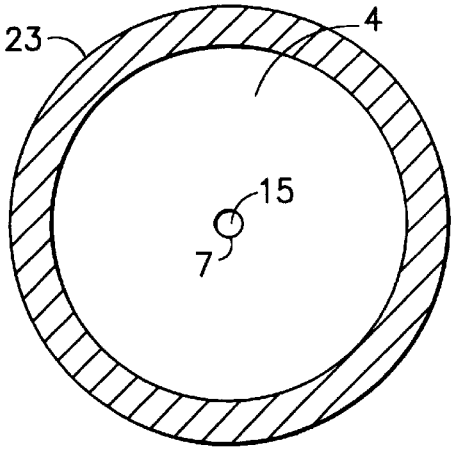
FIG. 1B is a sectional view taken along line 1B—1B in FIG. 1A.

Referring to FIGS. 1A and 1B, the lamp envelope (discharge lamp vessel) 1, which is preferably cylindrical, includes a partition unit 2 and a side wall 23. The partition unit 2 has a partition 3 which separates the interior of the lamp envelope 1 into two subspaces 4 and 5. Both the subspaces 4 and 5 communicate with each other through an opening (aperture) 7 extending along the cylinder axis 6 of the lamp envelope 1. Both subspaces 4 and 5 are closed-off (hermetically sealed) at each of the opposite sides 8 and 9 of the lamp envelope 1. One side 8 is closed by means of a cover 10 which is formed integrally with the partition unit 2. The preferably cylindrical partition unit 2 including integral cover 10, is made of an opaque (non-transparent), high temperature-resistance material which can withstand temperatures of up to about 1000° C. to up to about 3800° C.

The partition unit 2 can be made of the following materials:

(a) aluminium oxide (high temperature stability up to 2050° C.), (b) aluminium nitride (high temperature stability up to 2500° C.; temperature of decomposition), (c) boron nitride (high temperature stability up to 2450° C.; temperature of decomposition), (d) thorium oxide (high temperature stability up to 3300° C.), (e) beryllium oxide (high temperature stability up to 2450° C.), (f) diamond (high temperature stability up to 3800° C.), (g) tungsten (high temperature stability up to 3380° C.) and (h) molybdenum (high temperature stability up to 2600° C.).

The lamp envelope 1 comprises the partition unit 2, a cover at side 8 and a radiation emission window 11 at side 9. The radiation emission window 11 is made of a material pervious to the radiation generated in the interior of lamp envelope 1, through which the radiation exits along axis 6. Both the sides 8 and 9 are provided with externally attached electrodes 13,14, respectively, via which the excitation by the capacitive generation of the energy in the interior of the lamp envelope 1 takes place in such a manner that a plasma is generated in subspaces 4, 5, as well as in the area of the opening or aperture 7. The generated plasma passes restrictively through the aperture 7 for the purpose of increasing the intensity thereof (causing a "pinched arc discharge"). A planar-type circular electrode 14, which can be made from gold-plated copper, is provided along axis 6 with a radiation exit opening 15, which is disposed on the radiation emission window 11.

In a preferred embodiment of the present invention, the partition unit 2 is made of aluminum oxide, and the radiation emission window 11 is made of silica glass. The radiation emission window 11 is connected to the partition unit 2 by a molten glass frit connection, whereby a hermetically sealed closure is provided by thermal treatment. Thus, it is also possible to provide a tightly sealed connection or bonding between the radiation emission window 11 and the partition unit 2 by the melting of glass. The aperture 7 in the partition 3 preferably has a diameter of from about 0.1 mm to 6 mm and comprises a channel having a length of from about 0.01 mm to about 90 mm. In this embodiment of the present invention, the outer diameter of the entire system including the electrode (s), and the partition unit 2 with sides 8 and 9, which form the discharge lamp vessel, is in the range of from about 5 to about 80 mm. The interior of the lamp envelope 1 is filled preferably with deuterium at a cold inflation pressure of from about 1 to about 100 mbar.

It is possible, aside from deuterium, to also use other charge gases as the gas fill. In that case, a more intense emission of the confined plasma is observed. Basically, inert gases, as well as hydrogen, metal vapors (for example, mercury vapor) and reactive gases, as well as combinations thereof, can be used as the charge gas or gas fill.

In a further embodiment of the present invention, the partition unit 2 is made of aluminum nitride. Aside from silica glass, it is also possible to make the radiation emission window 11 from a glass, such as a UV-pervious glass or from sapphire. Inside the lamp envelope 1, the partition unit 2 takes up as large a volume of the interior as possible, while still providing sufficient volume for subspaces 4 and 5. Inside the lamp envelope 1, not only the rearward section of partition unit 2, but also the partition 3 can be metallized and serve as a reflector. This can be done, for example, by lining surfaces with a reflecting ceramic material, or by metallic coating or metallization of the surfaces.

Additionally, it is possible to design the partition unit 2 such that the aperture 7 therethrough is disposed in an exit direction along radiation axis 6, with the partition unit 2 having a reflecting surface possessing an axially symmetric reflector geometry, such as, for example, in the form of a hollow cone or truncated hollow cone, respectively, or in the form of a paraboloid or hyperboloid, respectively.

Furthermore, it is possible to make the partition unit 2 from boron nitride, thorium oxide, beryllium oxide or a polycrystalline diamond. These materials can withstand high thermal wall loads and withstand temperatures of up to about 1000° C. to up to about 3800° C., without impairment or deformation.

Figure 2:
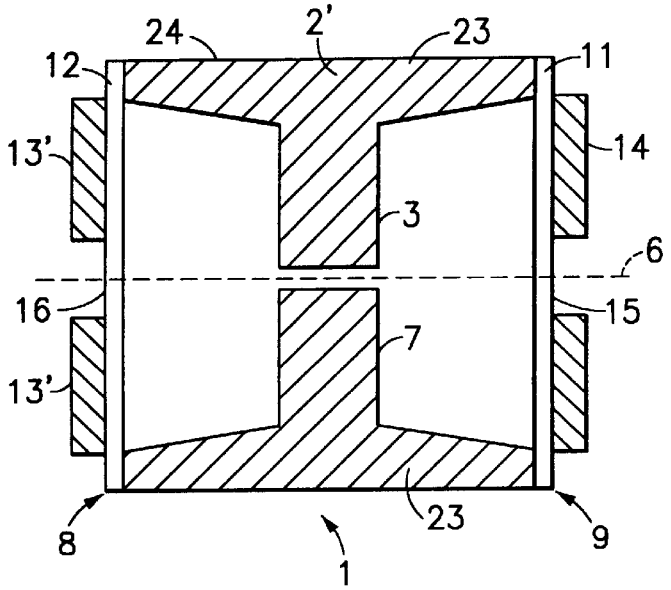
FIG. 2 is a longitudinal sectional view of another embodiment of the discharge lamp depicted in FIG. 1A, having a radiation exit window at both ends thereof.

FIG. 2 shows a lamp envelope 1 with a partition unit 2' which, in contrast to the partition unit 2 of FIG. 1A, includes a radiation passing member (opening) at both of its sides 8 and 9 along its optical axis 6, whereby both the sides 8 and 9 are hermetically sealed by the radiation exit windows 11 and 12, respectively, along the cylinder axis 6 which passes through the opening 7. On the radiation exit windows 11, 12, the electrodes 13', 14, respectively, are located, which are provided with respective openings 15, 16 along the radiation axis 6. As has been described hereinabove with respect of FIG. 1A, the subspaces 4 and 5 can also be provided with a reflecting interior surface. Moreover, it is also possible to provide both subspaces 4 and 5 with a reflector geometry, for example, in the form of a hollow cone or a truncated hollow cone, respectively, or, the interior surface can be provided in the shape of a paraboloid.

Figure 3:
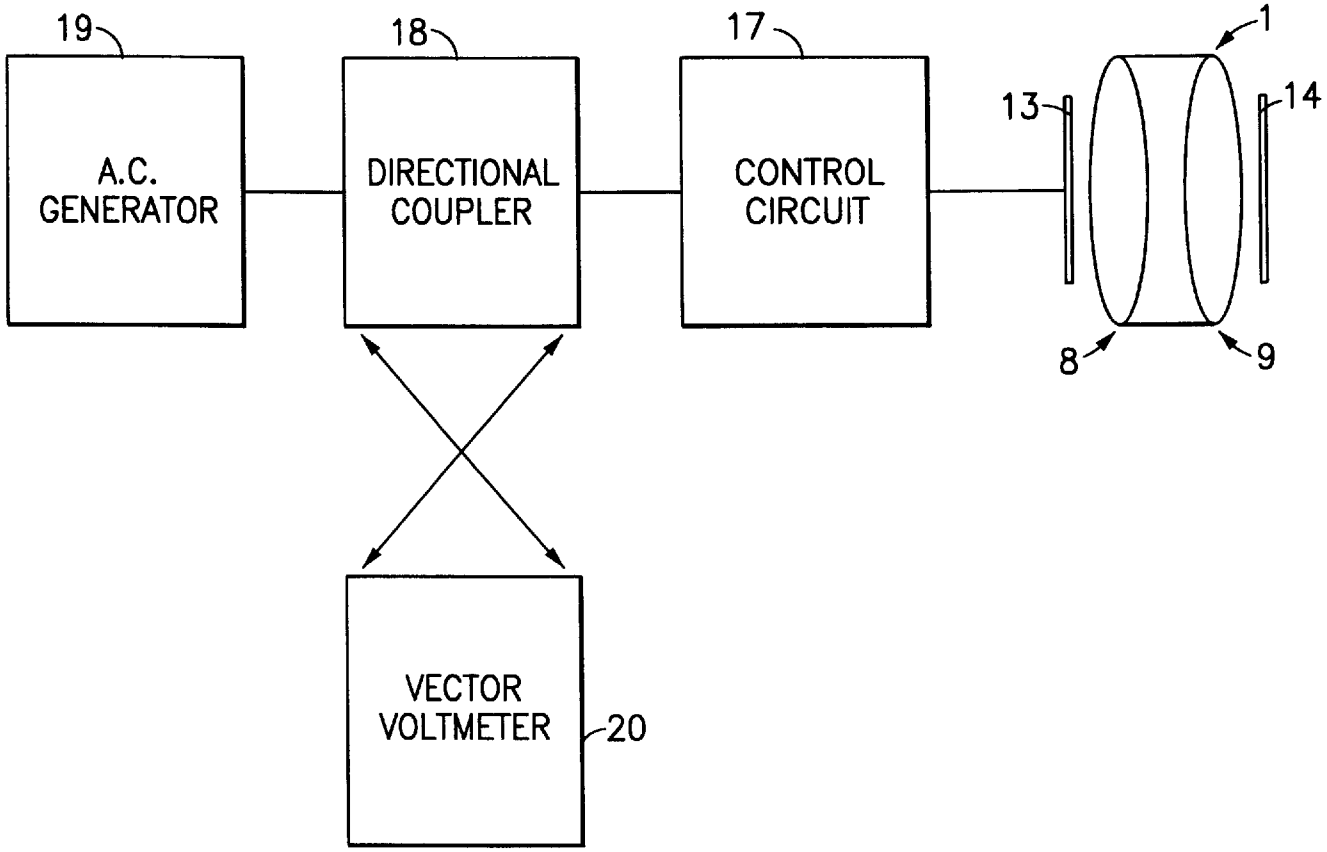
FIG. 3 is a schematic diagram showing a capacitatively excited gas discharge lamp together with an electrical circuit arrangement.

FIG. 3 shows a circuit arrangement for providing electrical control. The lamp envelope 1 includes at each of its front sides 8, 9, electrodes 13, 14, which can be capacitatively excited via an electrical control circuit 17 and a directional coupler 18 by an A.C. generator 19. The A.C. generator 19 provides outputs in the range of from about 10 to about 100 watts, whereby the upper frequency limit is at approximately 2.45 gigahertz and the lower frequency is at approximately 0.01 MHz. The directional coupler 18 serves solely for uncoupling a measuring signal for optimizing the control circuit 17.

In practice, the generator 19 is operated in the frequency range of from about 0.01 to about 2450 megahertz. For carrying out measurements, the directional coupler 18, which is located between control circuit 17 and generator 19, is connected with a vector voltmeter 20.

In practice, operating the discharge lamp of the present invention in a frequency range of from about 500 to about 2450 megahertz is advantageous, whereby the reactance of the lamp approaches the impedance of the connection lead with a standard surge impedance of, for example, 50 Ω, so that only small losses occur. Basically, any frequency can be used to control the discharge lamp of the present invention, whereby with low frequencies, for example, in the range of about 100 KHz to about 500 MHz, a direct matching of the generator output impedance is possible, so that only small losses occur.

Figure 4:
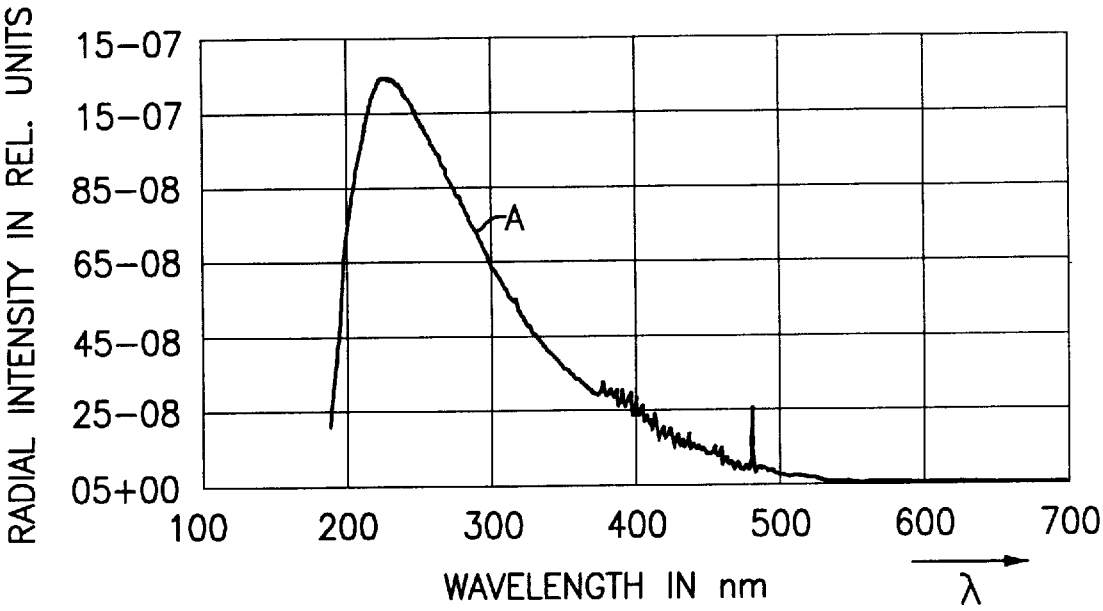
FIG. 4 is a graph showing the spectrum of the radiation emitted from a discharge lamp of the present invention and having a deuterium charge.

FIG. 4 shows a curve A which is the spectral energy distribution as a function of wavelength X when using the radiation arrangement according to a deuterium lamp of the present invention. With a half-width value of approximately 50° to 80° along the radiation axis 6, the spatial spectral radiation characteristic according to the present invention is more strongly directed, as is the case with conventional deuterium lamps with a half-width value exceeding about 36°. The range of the continuum registers a maximum of approximately 220 nm, whereby the emission in the range of approximately 180 nm to 360 nm is free of lines.

Figure 5:
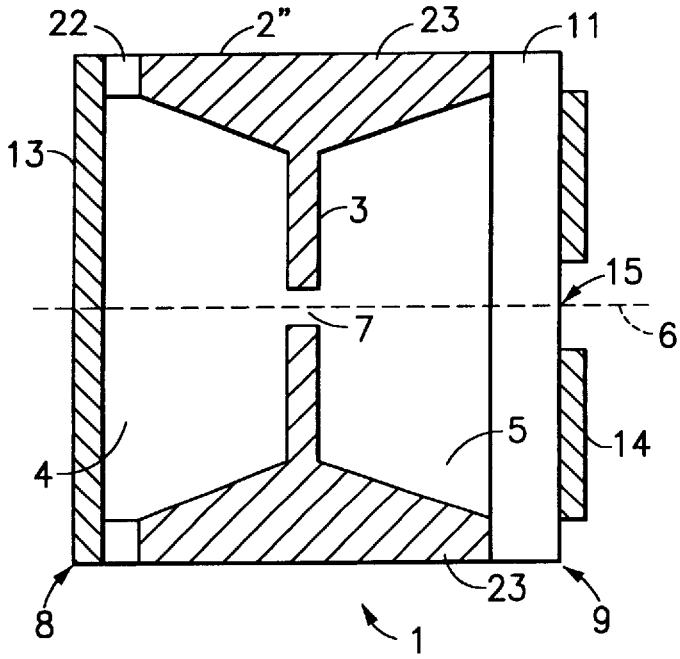
FIG. 5 is a longitudinal sectional view of another embodiment of the discharge lamp of the present invention having at one sealed end thereof a radiation exit window and having at an opposite sealed end thereof an electrode.

Referring to FIG. 5, it is also possible to provide a discharge lamp according to the present invention with a partition unit 2" made of a metal with a high temperature stability, for example, molybdenum or tungsten. In this case, the partition unit 2" (which is electrically conductive) is electrically insulated with respect to the electrodes 13, 14 to avoid a short circuit. The electrical insulation of the first electrode 13 is provided by means of an insulator 22 (which is circular if the lamp envelope 1 and the partition unit 2" are cylindrical). The insulator 22 can, for example, be made of a high temperature-resistant ceramic material, such as aluminum oxide or aluminum nitride. The second electrode 14 is insulated with respect to the partition unit 2" by means of the electrically insulating material of the radiation exit window 11. The attachment and sealing of the electrode 13 and the insulator 22 to the partition unit 2", are accomplished, for example, by gas soldering. This embodiment of the discharge lamp according to the present invention can also be operated according to U.S. Pat. No. 5,327,049 by using deuterium with a cold inflation pressure of about 1 to about 100 mbar, preferably at about 9 mbar. The aperture 7 in the partition 3 comprises a channel having a length of from about 0.01 to about 90 mm. The diameter of the aperture 7 is from about 0.1 to about 6 mm. In practice, despite the expected occurrence of eddy current fields, no excessive heating has been experienced.

Figure 6:
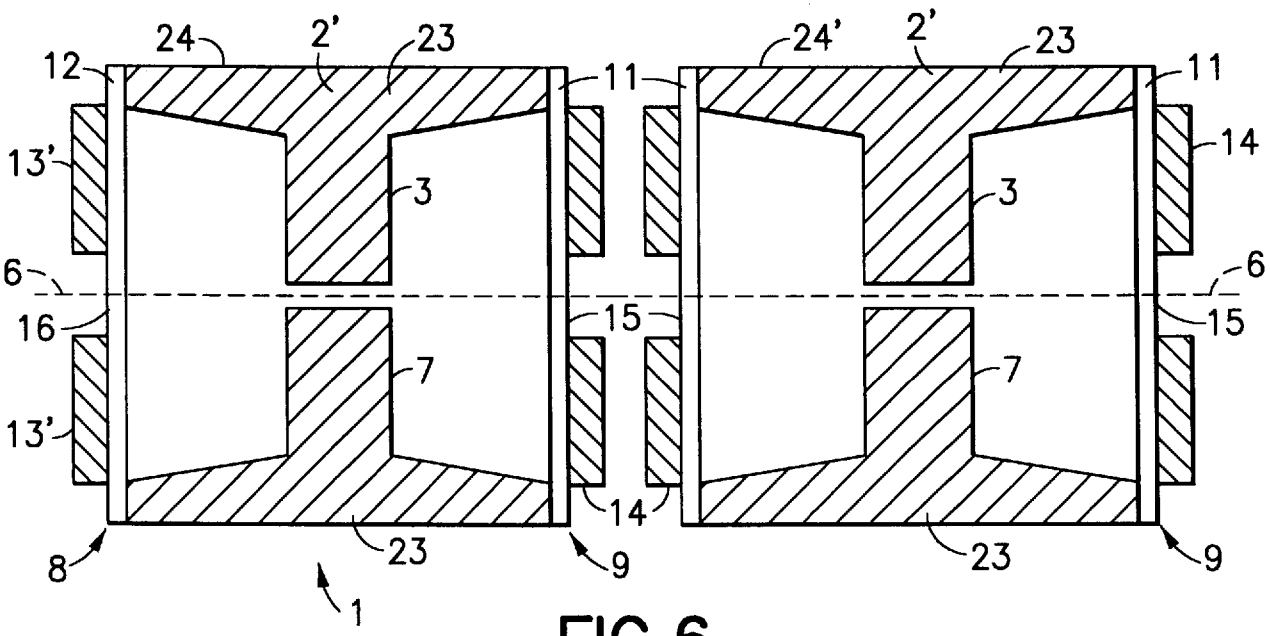
FIG. 6 is a longitudinal sectional view of two discharge lamps, as shown in FIG. 2, in series.

As shown in FIG. 6, a particularly advantageous embodiment of the present invention is depicted wherein two discharge lamps 24,24' as shown in FIG. 2, are arranged in series along a radiation axis 6, whereby an increase of the radiation intensity can be obtained by superimposing the radiation emitted by the individual discharge lamps 24,24'.

The present invention is advantageous in that it provides a gas discharge lamp having a large spectral bandwidth in the continuum of the emitted radiation, without impairing the lamp atmosphere, because electrodes do not intrude into the plasma in the lamp. Additionally, the simple geometric construction afforded by the present invention permits a very small size, so that, if required, attachment of the radiation source onto a printed circuit board is possible.

A particularly advantageous feature of the present invention is the capability of providing a discharge lamp with radiation exit windows which are placed opposite each other along the optical axis, since the spectrum of the radiation guided along the optical axis can be supplemented with the aid of additional series-arranged radiation sources. In this manner it is possible, for example, to superimpose additional components of the visible and/or infrared spectrum with the UV radiation generated by the discharge lamp according to the invention.

It will be appreciated that the instant specification is set forth by way of illustration and not limitation, and that various modifications and changes may be made without departing from the spirit and scope of the present invention.

What is claimed is:

1. A low-pressure discharge lamp comprising:

(a) a lamp envelope having a first sealed end portion and a second sealed end portion, said lamp envelope having a gas fill sealed therein, said gas fill forming a plasma in response to an application of a high-frequency electromagnetic field, said lamp envelope including:

a partition unit comprising:

(i) a side wall defining an interior space of said lamp envelope and (ii) a partition extending inwardly from said side wall and being formed integrally of an opaque, high temperature-resistant material as a single piece with said side wall, said partition disposed between said first sealed end portion and said second sealed end portion to divide said interior space of said lamp envelope into a first subspace and a second subspace, said partition having an aperture therethrough which communicates with said first subspace and said second subspace, said aperture having a cross-sectional size which is substantially smaller than a cross-sectional size of said lamp envelope at least at said first sealed end portion or said second sealed end portion, thereby constricting the plasma such that radiation generated by the plasma is emitted from said lamp envelope along an optical axis of said lamp envelope which coincides with an optical axis of said aperture, at least one of said first sealed end portion and said second sealed end portion including a radiation emission window which is pervious to radiation generated by the plasma, and (b) an electrode disposed at each of said first sealed end portion and said second sealed end portion, at least one of said electrodes being disposed on said radiation emission window, said at least one electrode having an opening which coincides with said optical axis of said lamp envelope and is in registration with said optical axis of said aperture.

2. The discharge lamp according to claim 1, wherein said partition unit is made of a material which can withstand temperatures of up to about 1000° C. to up to about 3800° C.

3. The discharge lamp according to claim 1, wherein said aperture comprises a linear channel.

4. The discharge lamp according to claim 1, wherein the partition unit is a generally cylindrical body and the aperture is generally cylindrical.

5. The discharge lamp according to claim 1, wherein the partition has at least one reflecting surface.

6. The discharge lamp according to claim 1, wherein each of said first sealed end portion and said second sealed end portion includes a radiation emission window and an electrode is disposed on each of the radiation emission windows, each of said electrodes having an opening therethrough which coincides with said optical axis of said lamp envelope and is in registration with said optical axis of said aperture.

7. The discharge lamp according to claim 1, wherein said aperture of said partition is circular and has a diameter of from about 0.1 to about 6 mm.

8. The discharge lamp according to claim 1, wherein said partition unit is made of a material selected from the group consisting of aluminum oxide, aluminum nitride and boron nitride.

9. The discharge lamp according to claim 1, wherein said partition unit is made of a material selected from the group consisting of thorium oxide, beryllium oxide and a polycrystalline diamond.

10. The discharge lamp according to claim 1, wherein said radiation emission window is made of a material selected from the group consisting of silica glass, UV-pervious glass and sapphire.

11. The discharge lamp according to claim 1, wherein the partition unit is made of metal and an electrically insulating component is disposed between another of said at least one of said electrodes and said partition unit, said another of said at least one electrodes comprising another of said first sealed end portion and said second sealed end portion which does not include a radiation emission window.

12. The discharge lamp according to claim 1, wherein the gas fill is deuterium with a cold inflation pressure of about 1 to about 100 mbar.

13. The discharge lamp according to claim 1, wherein said at least one electrode is connected to a high-frequency generator which generates an excitation frequency of about 0.01 to about 2450 MHz.

14. The discharge lamp according to claim 1, wherein said aperture in said partition has a diameter of about 0.01 mm to about 90 mm.

15. The discharge lamp according to claim 3, wherein said linear channel has a length of about 0.01 mm to about 90 mm.

16. The discharge lamp according to claim 1, wherein another of said first sealed end portion and said second sealed end portion which does not include a radiation emission window, is formed integrally as one piece with said partition unit.

17. A discharge lamp unit comprising:

a first low-pressure discharge lamp according to claim 1, and a second low-pressure discharge lamp according to claim 1 and having a radiation axis which coincides with the optical axis of the first low-pressure discharge lamp.

* * * * *